US006341401B1

(12) United States Patent
Lin

(10) Patent No.: US 6,341,401 B1
(45) Date of Patent: Jan. 29, 2002

(54) SPONGE MOP ASSEMBLY

(76) Inventor: Ta Cheng Lin, No. 126, Lane 450, Yeou Yuan S. Rd., Lung Jing Hsiang, Taichung Hsien (TW)

( * ) Notice: Subject to any disclaimer, the term of this patent is extended or adjusted under 35 U.S.C. 154(b) by 0 days.

(21) Appl. No.: 09/634,291

(22) Filed: Aug. 9, 2000

(51) Int. Cl.[7] ..... A47L 13/146
(52) U.S. Cl. ..... 15/119.2; 15/144.2
(58) Field of Search ..... 15/116.2, 144.2, 15/119.2, 244.2

(56) References Cited

U.S. PATENT DOCUMENTS 5,097,561 A * 3/1992 Torres ..... 15/116.2
5,528,791 A * 6/1996 Wilson ..... 15/119.2

FOREIGN PATENT DOCUMENTS

AU 248866 * 8/1960 ..... 15/119.2
CH 332039 * 9/1958 ..... 15/119.2
DE 596139 * 4/1934 ..... 15/119.2
DE 1125604 * 3/1962 ..... 15/119.2
IT 583434 * 10/1958 ..... 15/119.2

* cited by examiner

*Primary Examiner*—Randall E. Chin
(74) *Attorney, Agent, or Firm*—Rosenberg, Klein & Lee

(57) ABSTRACT

A sponge mop assembly includes a handle and a frame is pivotally connected to the handle. A sponge is movably connected to the frame and located between two squeezing members on the frame. A lever is pivotally connected to the handle and a link device is connected between the lever and the sponge. A sphere is connected to the handle and rotatably obtained in a neck on the frame so that the handle is positioned at angle relative to the frame. Each squeezing member has an extension extending in a direction away from the sponge so that when the squeezing members are rotated to squeeze the sponge, the extensions squeeze the lower portion of the sponge to remove water in the sponge.

16 Claims, 7 Drawing Sheets

SPONGE MOP ASSEMBLY

FIELD OF THE INVENTION

The present invention relates to a sponge mop assembly having a pivotable handle with respect to the sponge, arcuate pressing plates on two sides of the sponge, and two-section pivotable link connected between the sponge and a lever.

BACKGROUND OF THE INVENTION

A conventional sponge mop generally includes a handle, a frame connected to a lower end of the handle, a sponge connected to the frame, and a lever pivotally connected to the handle. A link is connected between the lever and the sponge so that when pulling the lever away from the sponge, the sponge is lifted and squeezed by two rollers on two sides of the sponge. The water in the sponge is then removed from the sponge by the squeezing action by the rollers. However, the handle is fixedly connected to the frame and no angle adjustable feature is expected so that it is inconvenient for the user to use the sponge mop in a narrow space because the handle could be limited by objects between which the handle extends. Besides, the squeezing action cannot remove the water in the sponge completely because the gap between the two rollers is fixed so that the maximum squeezing width for the sponge is fixed. Therefore, the users often repeats the squeezing actions many times. This will cause the sponge to be deformed and the sponge becomes longer than it really was. In other words, the lower portion of the sponge cannot be lifted between the rollers because the sponge is prolonged.

The present invention intends to provide a sponge mop assembly that has a pivotable handle and effective squeezing plates so as to be advantageously used in different situations and the water in the sponge can be removed completely.

SUMMARY OF THE INVENTION

In accordance with one aspect of the present invention, there is provided a sponge mop assembly and comprising a handle pivotally connected to a frame to which a sponge is connected. A lever is pivotally connected to the handle and a link means is connected between the lever and the sponge. Two squeezing members on the frame and the sponge is located between the squeezing members.

The primary object of the present invention is to provide a sponge mop assembly which has a pivotable handle so as to be used in different situations.

Another object of the present invention is to provide a sponge mop assembly which has specially designed squeezing members each of which has an extension so as to remove water in the sponge completely.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
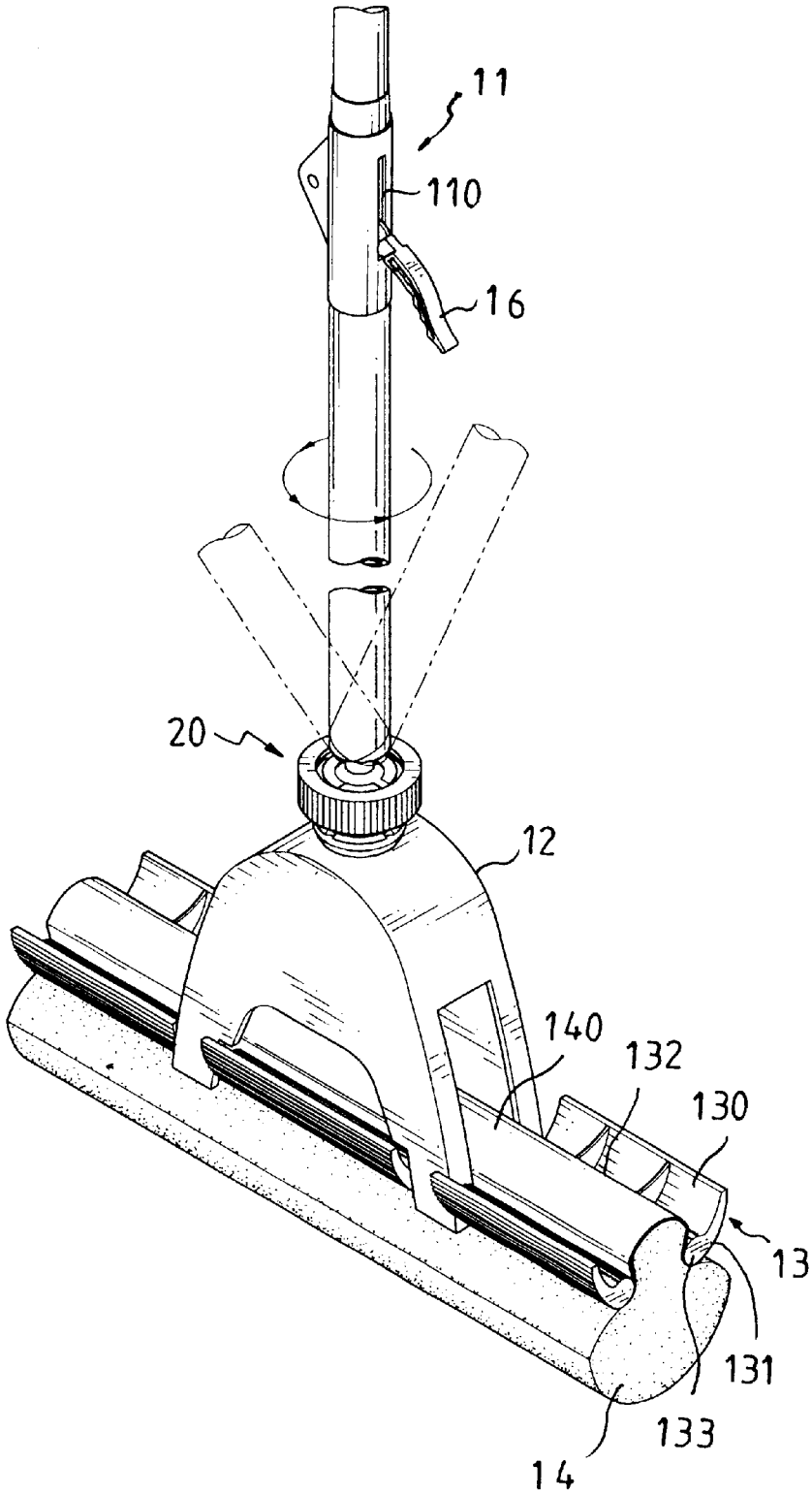
FIG. 1 is a perspective view to show a sponge mop assembly of the present invention.
Figure 2:
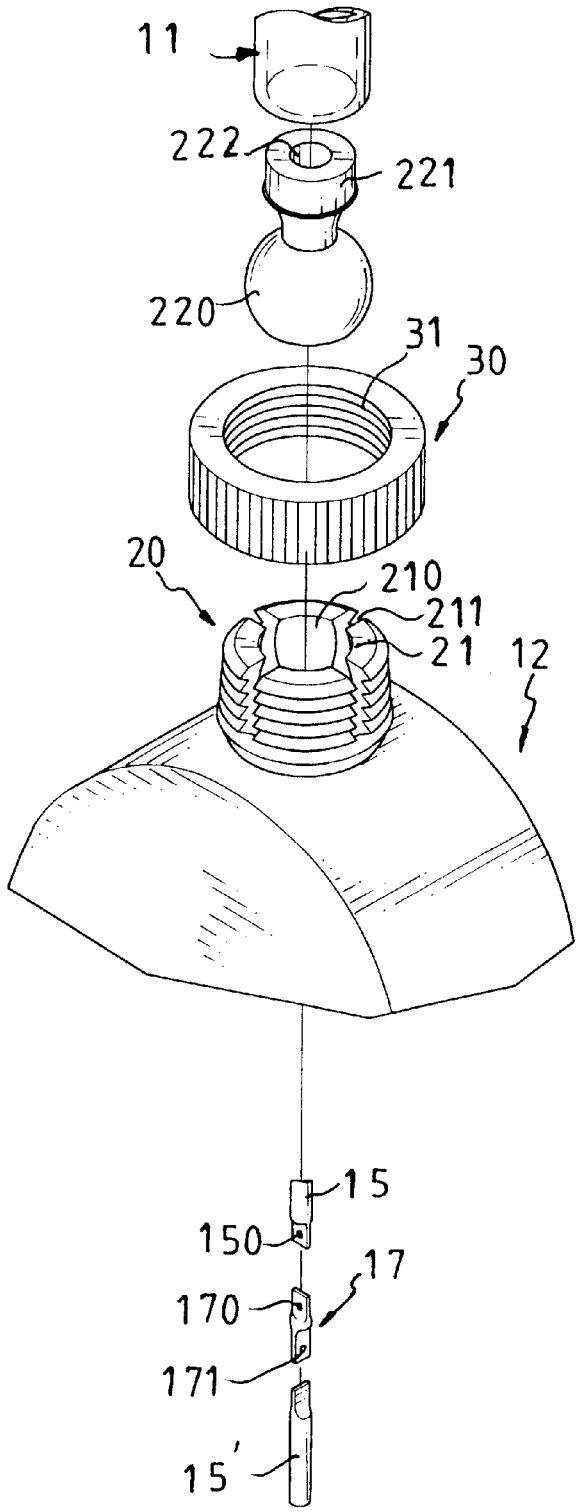
FIG. 2 is an exploded view to show a pivotal connection of the handle and the frame of the sponge mop assembly of the present invention.
Figure 3:
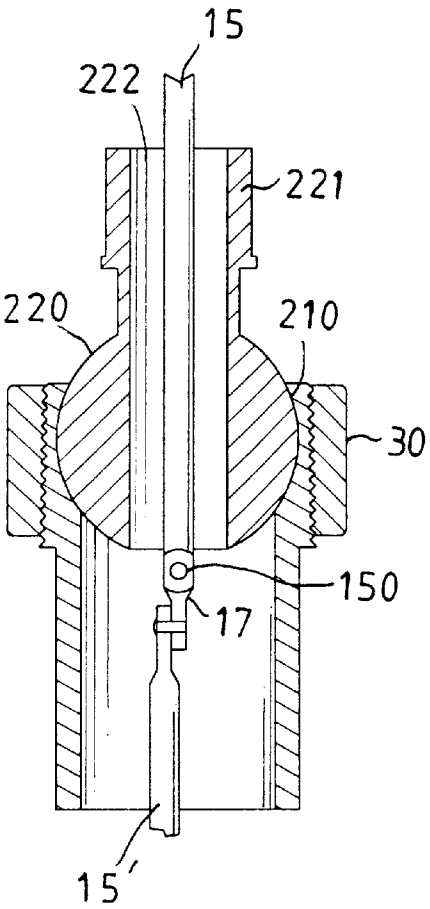
FIG. 3 is a cross sectional view to show the pivotal connection of the handle and the frame when the handle is located upright.

Referring to FIGS. 1 to 3, a sponge mop assembly of the present invention comprises a handle 11 with a lever 16 pivotally connected thereto and a frame 12 is pivotally connected to a lower end of the handle 11. A sponge 14 is movably connected to the frame 12. Two squeezing members 13 are connected to the frame 12 and the sponge 14 is located between the squeezing members 13. A link means is movably received in the handle 11 and connected between a top plate 140 of the sponge 14 and an end of the lever 16. The other end of the lever 16 extends from a hole 110 in the handle 11 so that a user may conveniently access the lever 16. A receiving member 20 which is in a form of a threaded neck extends from a top of the frame 12 and a plurality of slits 211 are defined in the threaded neck so as to separate the threaded neck into partitions which are deformable and close with each other because of the slits 211. A sphere 220 is connected to a base portion 221 which is securely engaged with the lower end of the handle 11 and the sphere 220 is rotatably obtained in a space 210 enclosed by the threaded neck. A collar 30 is threadedly engaged with the threaded neck to squeeze the partitions of the threaded neck to hold the sphere 220 in position. The sphere 220 has a passage 222 defined therethrough and the link means extends through the passage 222.

Figure 4:
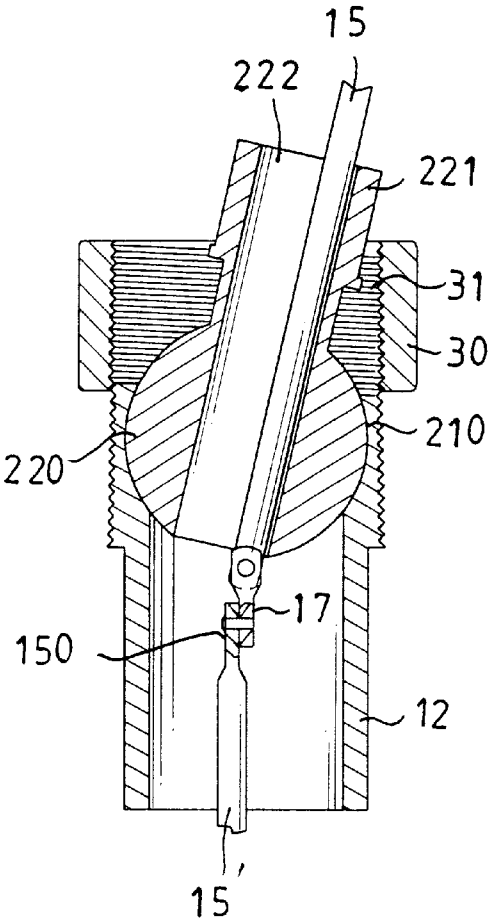
FIG. 4 is a cross sectional view to show the pivotal connection of the handle and the frame when the handle is pivoted.
Figure 9:
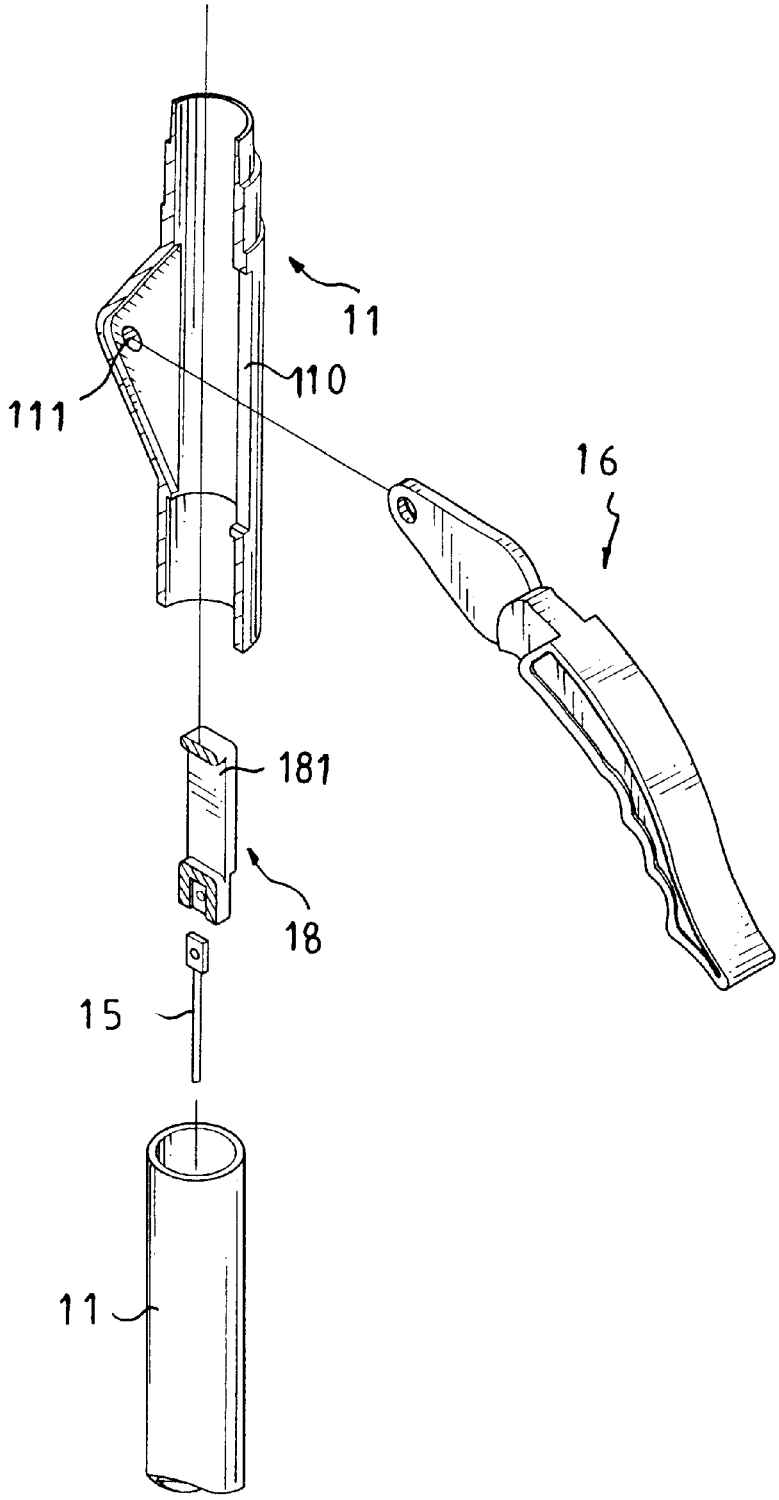
FIG. 9 is an exploded view to show a lever and a link means in the handle of the sponge mop assembly.

The link means includes a first section 15, a connection section 17 having a first end thereof pivotally connected to a first end of the first section 15 and a second end of the first section 15 connected to a plate 18 as shown in FIG. 9, and a second section 15' having a first end thereof pivotally connected to a second end of the connection section 17 and a second end of the second section 15' connected to the sponge 14. The first section 15 extends through the passage 222 in the sphere 220. The first end of the connection section 17 is a first flat end with a hole 170 defined therein and the second end of the connection section 17 is a second flat end with a hole 171 defined therein. The first flat end and the second flat end are perpendicular with each other. The first end of the first section 15 is pivotally connected to the first flat end and the first end of the second section 15' is pivotally connected to the second flat end. Therefore, basically, the first section 15 can be pivoted together with the pivotal movement of the sphere 220 as shown in FIG. 4.

Figure 10:
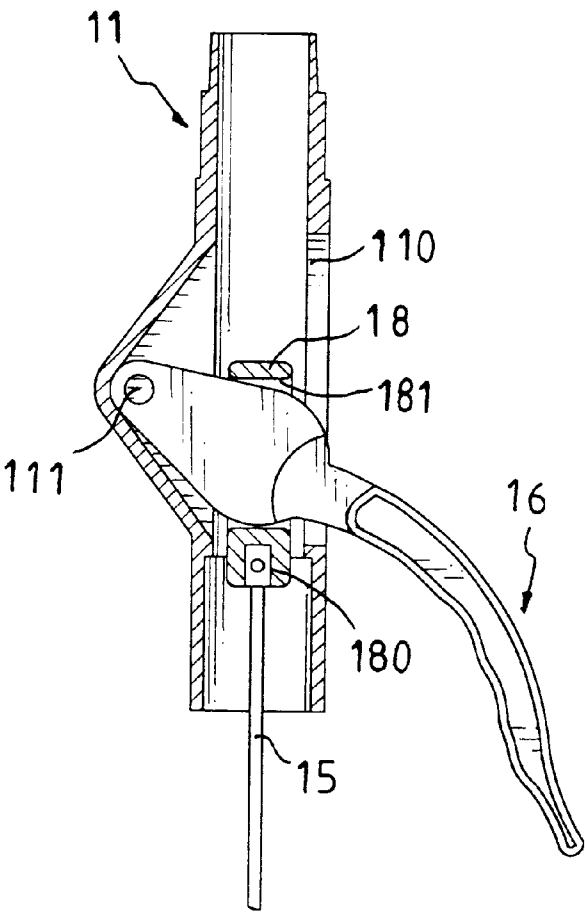
FIG. 10 is a side elevational view, partly in section, of the lever connected to the handle wherein the lever is not yet lifted.

As shown in FIGS. 9 and 10, the plate 18 has an aperture 181 so that the lever 16 extends through the aperture 181.

Figure 7:
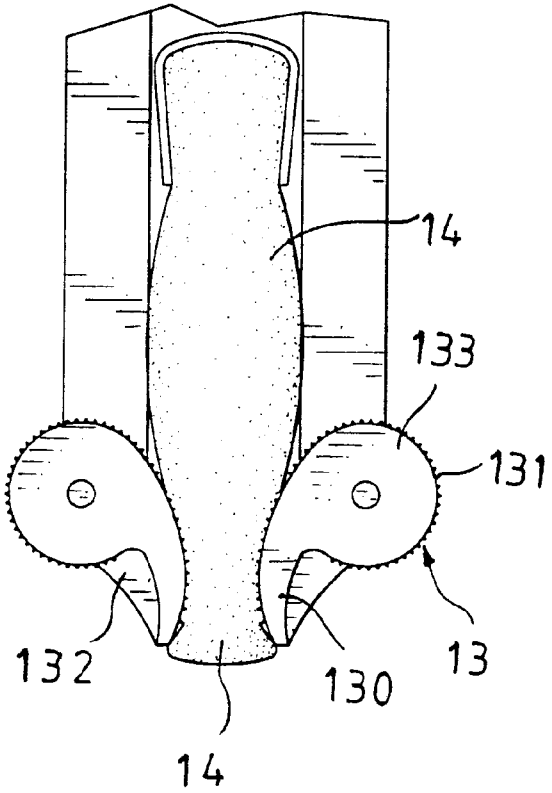
FIG. 7 is an illustrative view to show that the sponge is lifted and the two squeezing members are rotated to squeeze the sponge.
Figure 6:
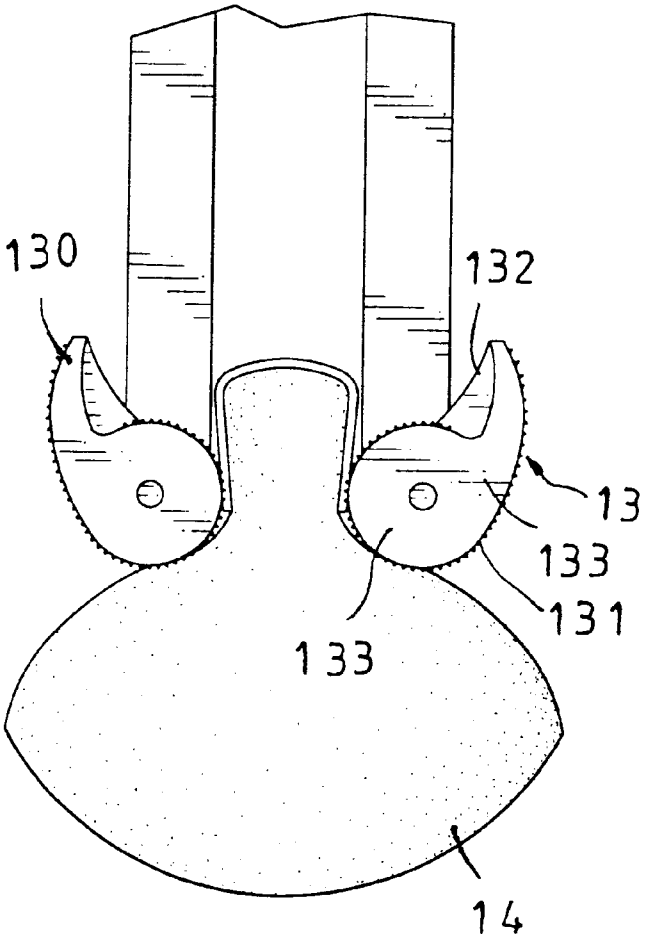
FIG. 6 is an illustrative view to show two squeezing members on two sides of the sponge.
Figure 8:
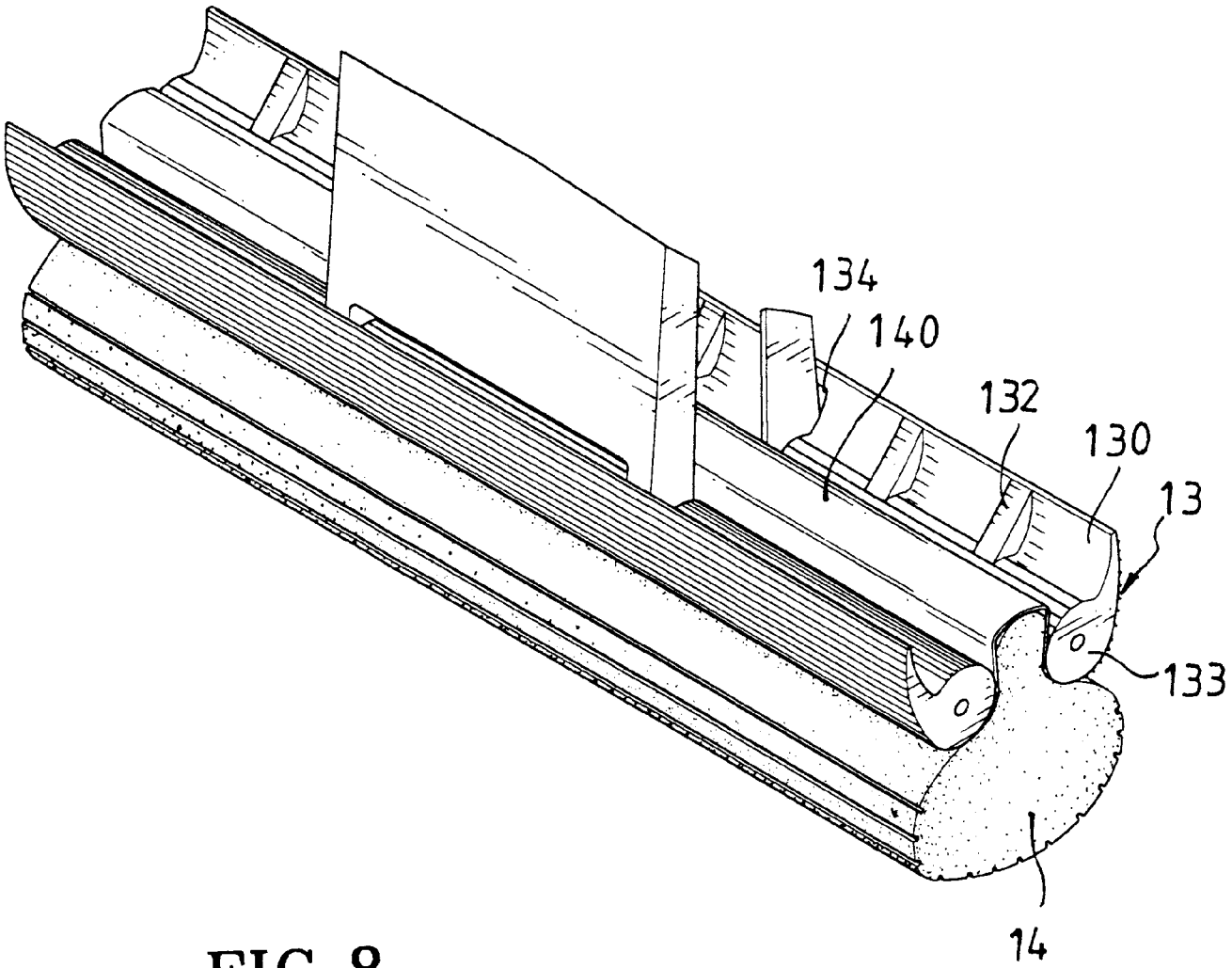
FIG. 8 is a perspective view to show another embodiment of squeezing members.
Figure 11:
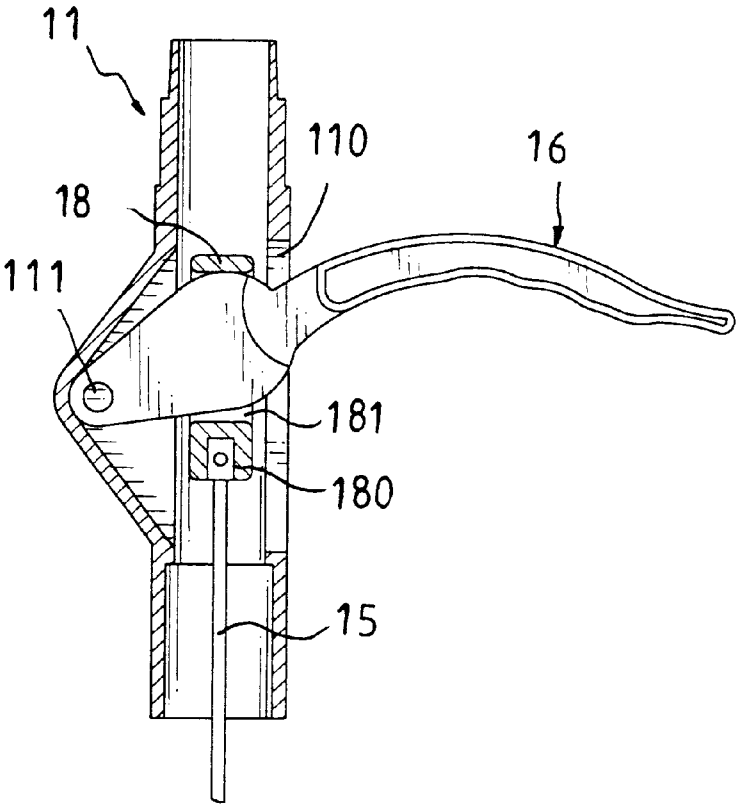
FIG. 11 is a side elevational view, partly in section, of the lever connected to the handle wherein the lever is lifted.

The handle 11 has a triangle protrusion through which a hole 111 is defined so that the lever 16 is pivotally connected to the protrusion. A shown in FIG. 11, when pulling the lever 16 upward, the plate 18 and the first section 15 are lifted. Further referring to FIGS. 6 and 7, the link means pulls the sponge 14 upward and the two squeezing members 13 are the rotated by the 1 upward movement of the sponge 14. Each squeezing member 13 includes a base portion 133 and an extension plate 130 extending from the base portion 133 toward a direction away from the sponge 14. A plurality of ridges 131 extends from each squeezing member 13 to bite into the sponge 14. Ribs 132 are connected between the extension plate 130 and the base portion 133 to enforce the structural strength of the squeezing members 13. The number of the squeezing members 13 can be six as shown in FIG. 1, and can be only two as shown in FIG. 8 wherein each of the two squeezing members 13 shown in FIG. 8 has holes 134 for the truss of the frame 12 to extend. As shown in FIG. 7, when the sponge 14 is lifted, it rotates the squeezing members 13 and is squeezed by the squeezing members 13. When the sponge 14 is lifted to an extreme position as shown in FIG. 7, the lower portion of the sponge 14 is squeezed by the extension plates 130 so that water in the sponge 14 can be removed completely.

Figure 5:
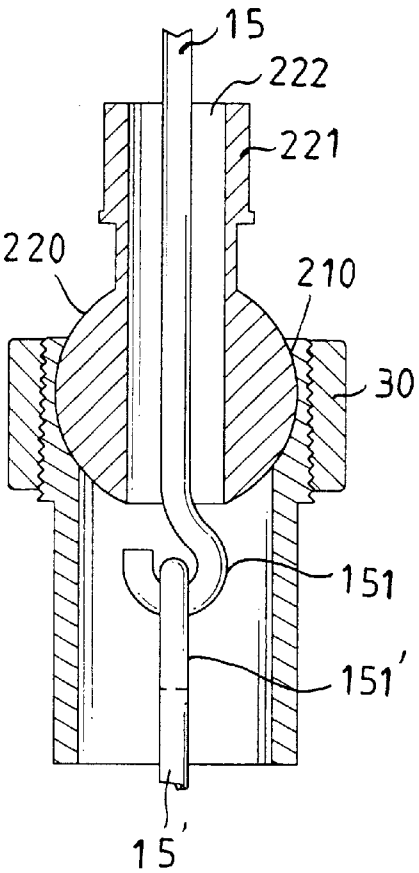
FIG. 5 is a cross sectional view to show another embodiment of the pivotal connection of the handle and the frame.

Referring to FIG. 5, the link means may also include only a first section 15 and a second section 15', wherein the first section 15 has a first hook 151 and the second section 15' having a second hook 151' which is hooked with the first hook 151.

While we have shown and described various embodiments in accordance with the present invention, it should be clear to those skilled in the art that further embodiments may be made without departing from the scope and spirit of the present invention.

What is claimed is:

1. A sponge mop assembly comprising:

a handle with a lever pivotally connected thereto;

a frame pivotally connected to an end of said handle and a sponge movably connected to said frame, a sphere connected to said end of said handle and a receiving member connected to said frame, said sphere rotatably engaged with said receiving member, two squeezing members connected to said frame and said sponge located between said squeezing members, and a link means movably received in said handle and connected between said sponge and said lever.

2. The sponge mop assembly as claimed in claim 1 wherein said receiving member is a threaded neck extending from said frame and a plurality of slits defined in said threaded neck, said sphere obtained in said threaded neck and a collar threadedly engaged with said threaded neck.

3. The sponge mop assembly as claimed in claim 1, wherein said sphere has a passage defined therethrough and said link means extends through said passage.

4. The sponge mop assembly as claimed in claim 3, wherein said link means includes a first section, a connection section having a first end thereof pivotally connected to a first end of said first section and a second end of said first section connected to said lever, and a second section having a first end thereof pivotally connected to a second end of said connection section and a second end of said second section connected to said sponge, said first section extending through said passage in said sphere.

5. The sponge mop assembly as claimed in claim 4, wherein said first end of said connection section is a first flat end with a hole defined therein and said second end of said connection section is a second flat end with a hole defined therein, said first flat end and said second flat end being perpendicular with each other.

6. The sponge mop assembly as claimed in claim 3, wherein said link means includes a first section and a second section, said first section having a first hook and said second section having a second hook which is hooked with said first hook.

7. The sponge mop assembly as claimed in claim 1 wherein each squeezing member having an extension plate extending in a direction away from said sponge.

8. The sponge mop assembly as claimed in claim 7 further comprising a plurality of ridges extending from each squeezing member.

9. A sponge mop assembly comprising:

a handle with a lever pivotally connected thereto;

a frame connected to an end of said handle and a sponge movably connected to said frame, two squeezing members connected to said frame and said sponge located between said squeezing members, each squeezing member having an extension plate extending in a direction away from said sponge, and a link means movably received in said handle and connected between said sponge and said lever.

10. The sponge mop assembly as claimed in claim 9 further comprising a plurality of ridges extending from each squeezing member.

11. The sponge mop assembly as claimed in claim 9 further comprising a sphere connected to said end of said handle and a receiving member connected to said frame, said sphere rotatably engaged with said receiving member.

12. The sponge mop assembly as claimed in claim 11 wherein said receiving member is a threaded neck extending from said frame and a plurality of slits defined in said threaded neck, said sphere obtained in said threaded neck and a collar threadedly engaged with said threaded neck.

13. The sponge mop assembly as claimed in claim 11, wherein said sphere has a passage defined therethrough and said link means extends through said passage.

14. The sponge mop assembly as claimed in claim 13, wherein said link means includes a first section, a connection section having a first end thereof pivotally connected to a first end of said first section and a second end of said first section connected to said lever, and a second section having a first end thereof pivotally connected to a second end of said connection section and a second end of said second section connected to said sponge, said first section extending through said passage in said sphere.

15. The sponge mop assembly as claimed in claim 14 wherein said first end of said connection section is a first flat end with a hole defined therein and said second end of said connection section is a second flat end with a hole defined therein, said first flat end and said second flat end being perpendicular with each other.

16. The sponge mop assembly as claimed in claim 13, wherein said link means includes a first section and a second section, said first section having a first hook and said second section having a second hook which is hooked with said first hook.

* * * * *